United States Patent [19]

Sugawara et al.

[11] Patent Number: 4,607,565

[45] Date of Patent: Aug. 26, 1986

[54] FLOW DEFLECTING ASSEMBLY

[75] Inventors: Norio Sugawara, Shiki; Motoyuki Nawa, Nara, both of Japan

[73] Assignee: Matsushita Electric Industrial Co., Ltd., Kadoma, Japan

[21] Appl. No.: 731,520

[22] Filed: May 7, 1985

[30] Foreign Application Priority Data

May 10, 1984 [JP] Japan ..... 59-93415
Jul. 19, 1984 [JP] Japan ..... 59-150007

[51] Int. Cl.[4] ..... F24F 7/00; F24F 13/00
[52] U.S. Cl. ..... 98/40.24; 98/40.26
[58] Field of Search ..... 98/40.24, 40.26, 94.2, 98/121.2

[56] References Cited

U.S. PATENT DOCUMENTS 3,063,357 11/1962 Eberhart ..... 98/40.24
3,257,931 6/1966 Lupton et al. ..... 98/40
3,314,249 4/1967 Lundbom ..... 98/40.24 X
3,358,577 12/1967 Thomson et al. ..... 98/40
3,391,629 7/1968 Snell ..... 98/40.26 X
3,468,239 9/1969 De Hart et al. ..... 98/40.24
3,949,656 4/1976 Lohmann ..... 98/40.24
4,407,186 10/1983 Izumi et al. ..... 98/40.24 X

FOREIGN PATENT DOCUMENTS 56-5955 1/1981 Japan .
58-5887 2/1983 Japan .

*Primary Examiner*—Lloyd L. King
*Attorney, Agent, or Firm*—Cushman, Darby & Cushman

[57] ABSTRACT

In the outlet part of a fluid passage generally rectangular in cross section defined by two parallel opposed broad walls spaced apart a short distance therebetween and two opposed narrower walls spaced apart a longer distance therebetween, the narrower walls curve outwards forming guide walls, and a row of deflecting blades of curved profile extend between the broad walls and are held in angle-adjustable manner between said curved faces of the guide walls to effectively deflect fluid flow without loss of flow rate by the attachment effect to the curved faces.

6 Claims, 18 Drawing Figures

FLOW DEFLECTING ASSEMBLY

BACKGROUND OF THE INVENTION

1. Field of the Invention:

The present invention relates generally to a flow deflecting assembly, and particularly concerns a flow deflecting assembly suitable for installation at the air outlet of an air conditioner so as to deflect the direction of flow of conditioned air.

2. Description of the Prior Art

In an air conditioner, in order to obtain comfortable air conditioning, air from an outlet of the air conditioner should be widely deflectable in desired directions. Hitherto a known flow deflecting assembly as disclosed in U.S. Pat. No. 3,358,577, which deflects air flow in a direction of smaller aspect ratio. As shown in FIG. 1, the deflection of air flow in such an assembly is accomplished by making the air flow through curved gaps defined by curved blades 1*a* or 1*b*. Though it is intended that the rate of air flow is not decreased, the apparatus of this prior art could not help but decrease the air flow rate because the flow deflection is made by greatly tilting the blades about their upstream edges, thereby resultantly making the outlet gap A′ between adjacent blades smaller than the inlet gap A.

SUMMARY OF THE INVENTION

Accordingly the present invention intends to provide an improved flow deflecting assembly which can deflect the flow of air through a large angle without considerable loss of the air flow rate. In order to provide the improved flow deflection, the present invention adopts outwardly curved guide walls at the outlet end of a fluid passage, and a pair of blades each having a curved profile disposed in the vicinity of the curved faces of the guide walls to deflect the air therealong.

That is, the flow deflecting assembly in accordance with the present invention comprises a fluid passage generally rectangular in cross section, defined by a pair of opposed broad walls disposed a short distance apart and a pair of opposed narrower walls disposed a longer distance apart and having an inlet and an outlet, the narrower walls forming a pair of guide walls which have curved faces curving outwards in the vicinity of the outlet, a pair of flow deflecting blades of curved profile, which are rotatable around center shafts of the blades, extend between the broad walls and are respectively disposed in the vicinities of the curved faces of the guide walls, gaps D between the shafts and the curved faces of the guide walls are smaller than the curvature radius R of the curved faces of the guide walls, the rearward edges of the blades are disposed downstream of the inlet of the fluid passage but upstream of the curved faces while the forward edges of the blades are disposed upstream of the outlet of the passage but downstream of the beginning of the curved faces to make the fluid flow attach to the curved faces of the guide walls, and a row of deflecting blades of curved profile held in angle-adjustable manner, which are disposed between the pair of deflecting blades with predetermined pitches therebetween.

As a result of the above-mentioned configuration, by tilting the blades with respect to the curved faces of the guide walls, the flow of the fluid passing through the gap between the guide walls and the blades and also between the blades is deflected to a great extent, and the flow of the fluid is attached to the curved faces of the guide walls, thereby resultantly greatly deflecting the whole flow in a direction toward the end parts of the curved face of the guide wall. In this way, by the attachment of the flow of fluid to the curved faces when deflecting the flow, in general the tilt angle of the blades may be moderate in comparison with that of the conventional flow deflecting assembly, and accordingly there is no undesirable lowering of the flow rate.

The flow deflecting assembly in accordance with the present invention can produce a widely diffusing flow by arranging the blades in symmetry with the center of the fluid passage.

DESCRIPTION OF THE PREFERRED EMBODIMENT

Figure 1:
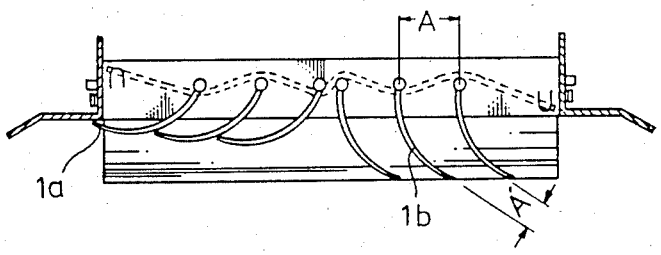
FIG.1 (Prior Art)
FIG. 1 is a sectional plan view of the conventional flow deflecting assembly.

Hereafter a first embodiment of the present invention is described with reference to the drawings FIG. 2 through FIG. 8. The flow deflecting assembly comprises a fluid passage 2, for instance an exit air passage of an air conditioner, which has an inlet 3 and an outlet 4. The fluid passage 2 is generally rectangular in cross section and is defined by a pair of space opposed parallel broad walls 21 and 22 which have a small gap W therebetween and a pair of space opposed narrower walls which have a larger gap S therebetween and have outwardly curved surfaces in the vicinity of the outlet 4, thereby forming guide walls 5 and 6.

Figure 4:
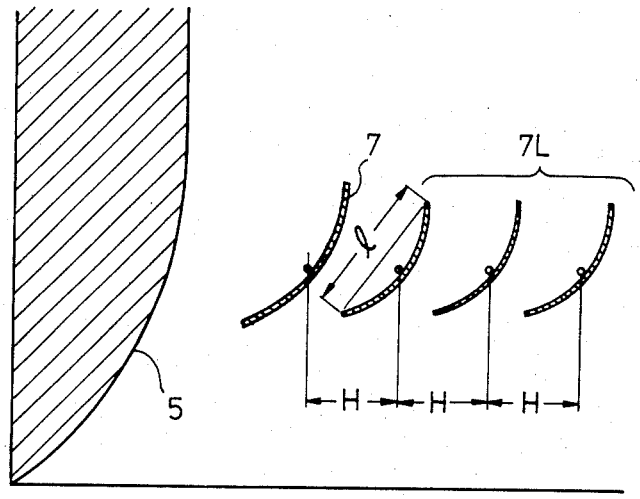
FIG. 4 is an enlarged view of a part of the assembly of FIG. 2.

A pair of flow deflecting blades 7 and 8 of curved profile which extend between the walls 21 and 22 and are mounted on rotatable center shafts 7b and 8b, are respectively disposed in the vicinities of the curved surfaces of the guide walls 5 and 6. Gaps D between the shafts 7b, 8b and the respective curved surfaces of the guide walls 5 and 6 are smaller than the curvature radius R of the curved surfaces of the guide walls. The forward edges 7a and 8a of the blades 7 and 8 are disposed in the fluid flow between the guide walls 5 and 6 while the rearward edges are disposed upstream of the curved surfaces of the guide walls. Several blades 7L and 8R mounted on center shafts are provided between the blades 7 and 8 with predetermined gaps therewith and inbetween in a row, so as to induce attachments of the flow of fluid flowing in the gaps between the guide walls 5, 6 and the blades 7, 8 by means of the Coanda effect. Gaps H, as shown in FIG. 4, between the shafts of the blades 7 and 7L and between the shafts of blades 7L, and similarly between the shafts of blades 8 and 8R and between the shafts of blades of 8R are preferably selected to be smaller than the chord length l the blades 7L and 8R for the sake of good deflection of the flows of the fluid. On the other hand, in order to decrease resistance to the flow, the total number of blades across the passage 2 is preferably small. Accordingly, the gap H is preferably about equal to the length l of the chord. Thus the flow of the fluid such as chilled air may be bent by cooperative operation of the guide walls 5 or 6 and the blades 7, 7R or 8, 8R in the directions shown by the thick white arrows in FIG. 6, FIG. 7 and FIG. 8. But the flow is not deflected in a direction toward either of the broad walls 21 or 22, because their opposed surfaces are flat and disposed parallel to each other.

Figure 5:
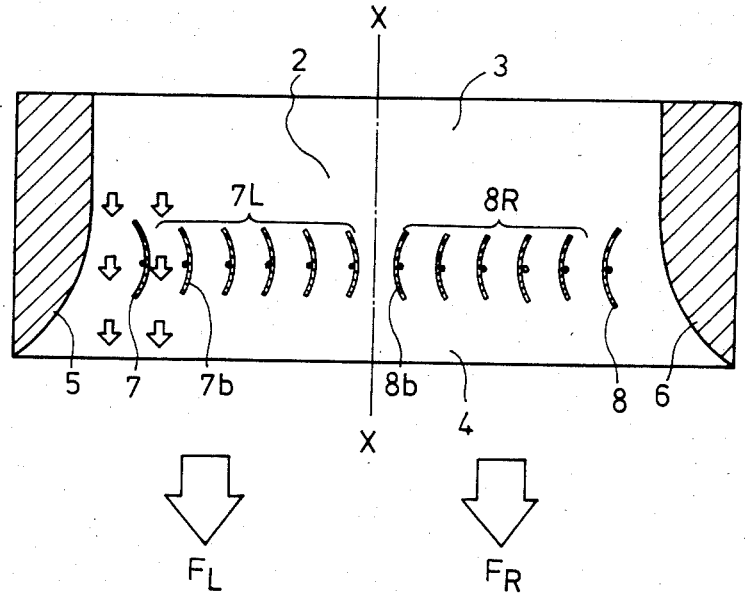
FIG. 5, FIG. 6, FIG. 7 and FIG. 8 are views of the embodiment of FIG. 2 in various modes of operation.

When the blades 7, 7L, 8R and 8 are adjusted as shown in FIG. 5, that is, when the chords of the blades are arranged in parallel with the center axis X—X of the passage 2, as shown in FIG. 5, the flow of the fluid is not bent, but is led straight to the outlet 4 as shown by the thick white arrows $F_L$ and $F_R$ in FIG. 5.

Figure 6:
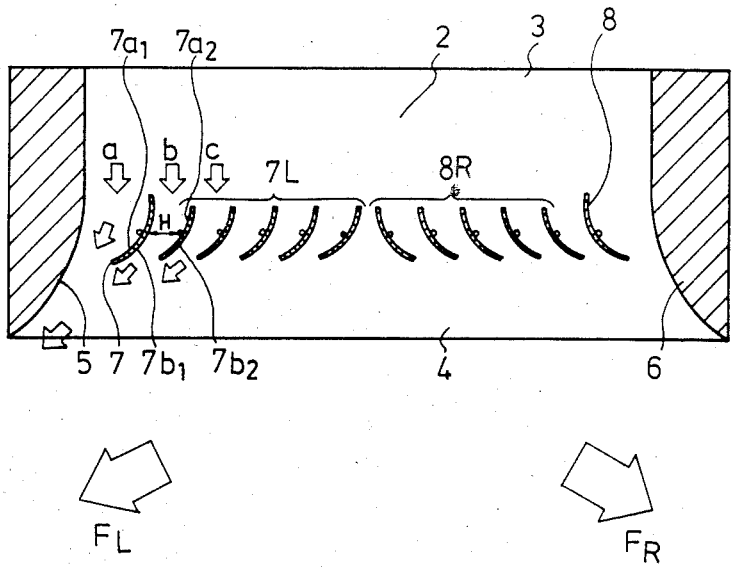

Next, as shown in FIG. 6 when the blades 7 and 7L are tilted in a direction so that their forward edges approach the curved surface of the guide wall 5, and the blades 8 and 8R are tilted in a direction so that their forward or downstream edges approach the curved surface of the guide wall 6, the left part flow "a" is bent so as to be attached to the curved wall 5 by operation of the concave face $7a_1$ of the blade 7, and the next divided flow b is also bent in the same direction so as to be attached to the convex face $7b_1$ by operation of concave face $7a_2$. In a similar way, flows of the fluid passing through the gaps between blades 7L are bent leftwards, i.e. toward the curved wall 5 by the blades 7L. As a result, the flow in the left half part of the passage 2 is deflected leftwards, and in symmetry with the left half part of the flow, the right half part of the flow is deflected rightwards, as shown in FIG. 6.

Figure 2:
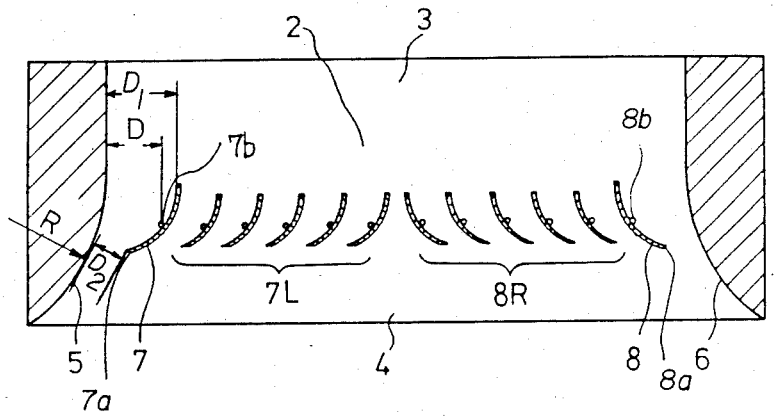
FIG. 2 is a sectional plan view of one example of a flow deflecting assembly embodying the present invention.
Figure 3:
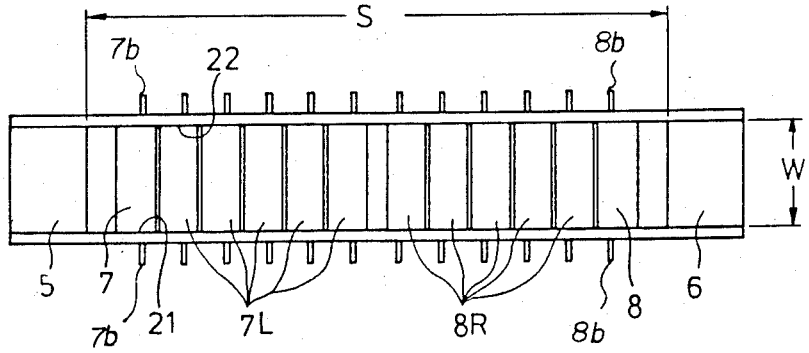
FIG. 3 is a front view of the flow deflecting assembly of FIG. 2.

In this case, the downstream edge 7a of the blade 7 (which is shown in FIG. 2) is disposed upstream of the ending point and downstream of the starting point of the curved surfaces of the guide walls 5 and 6, and the gap D between the shaft 7b and the curved surface of the guide wall 5 is smaller than the curvature radius R of that wall, so that the fluid flow passing through the gap between the blade 7 and the curved surface 5 adheres effectively to the curved surface 5 (the smaller the ratio of D/R, the more effective the adhesion). Further, as the rotation of the blade 7 on its center shaft 7b, the ratio of the front gap $D_2$ to the rear gap $D_1$ (which are shown in FIG. 2) is more easily changeable by means of a small angle adjustment of the blade 7, as compared with large angle adjustment required by the conventional blades which are shown in FIG. 1, so that the fluid flow is accelerated and the adhesion is promoted by the squeezing action by the blade, thereby more effectively adhering the flow to the curved surface in spite of the small angle adjustment. Further, the fluid flows passing through the gaps between the blades 7L are also bent toward the curved surface by the blades 7L and invited to adhere to the curved surface of the guide wall 5. As a result, in spite of the small angle adjustment of the blade 7 and blades 7L, they can obtain a large bending angle without losing appreciable flow quantity.

Figure 7:
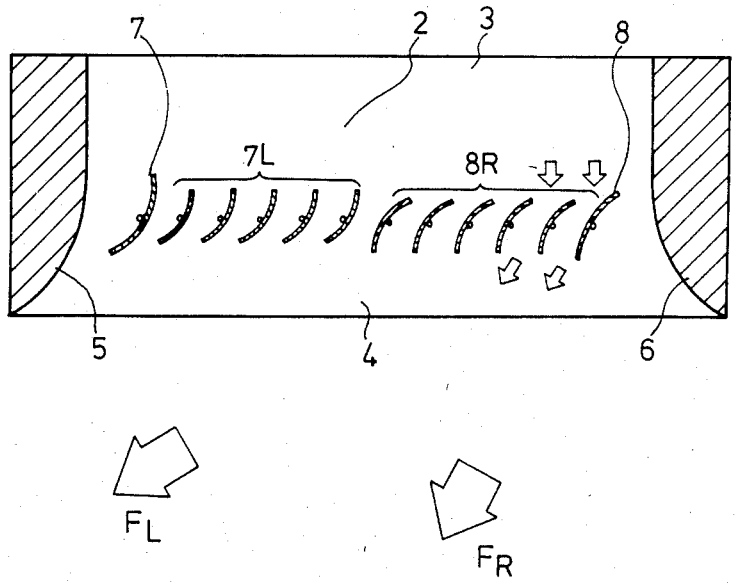

Next as shown in FIG. 7, when the right half blades 8 and 8R are adjusted such that their chords are generally parallel to the chords of the blades 7 and 7L of the left half part, the flow in the fluid of the right half of the passage in the fluid passage 2 is bent moderately leftwards as shown in FIG. 7.

As described with reference to FIG. 5 through FIG. 7, by adjusting the angular positions of the blades in various modes, the deflection mode of the flow can be changed: such (1) as diffusing to both sides of the central axis X—X, (2) directly along the central axis, or (3) in a direction left or right of that axis. In either of the first or third modes, the flow deflection is made by utilizing the attachment effect of the flow, and accordingly there is no need of for excessive tilting of the blades. Hence, the rate of flow is not decreased by such deflection.

Furthermore, by appropriately selecting the ratio of number of blades of the left part blades 7L to the right part blades 8R, it is possible to the ratio of flow rate of left side flow $F_L$ to right side flow $F_R$, and therefore appropriate flow deflection, corresponding to a desired purpose is obtainable.

Figure 8:
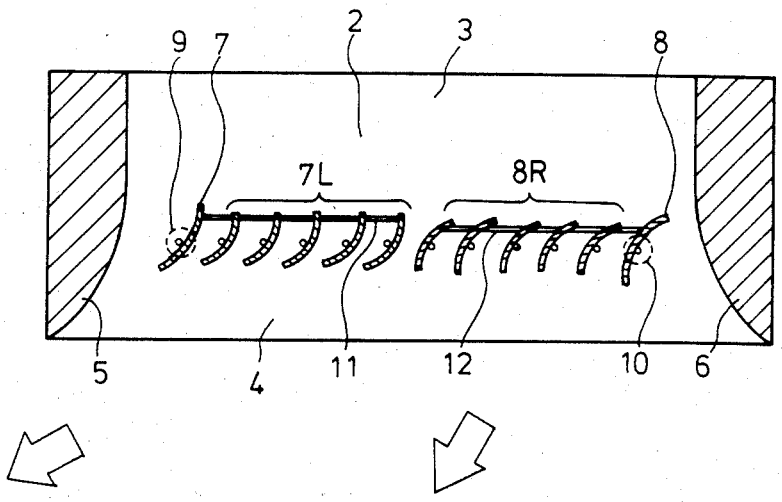
Figure 9:
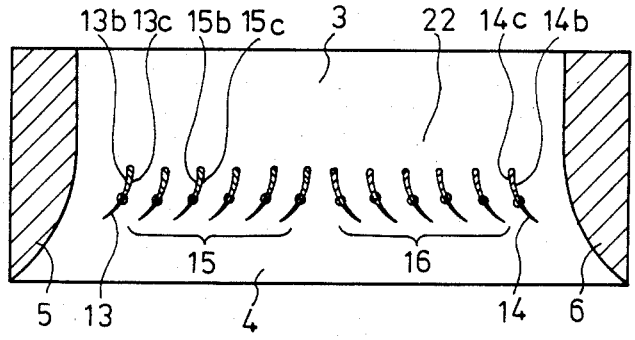
FIG. 9 is a sectional view corresponding to FIG. 2 of another embodiment of the flow deflecting assembly embodying the present invention.

Furthermore, as shown in FIG. 8, by providing a pair of blade adjusting motors 9 and 10 and further by linking the blade 7 to the blades 7L, and also the blade 8 to the blades 8R by connecting rods 11 and 12, respectively, the left part flow and the right part flow can be individually deflected by remote control.

Figure 10:
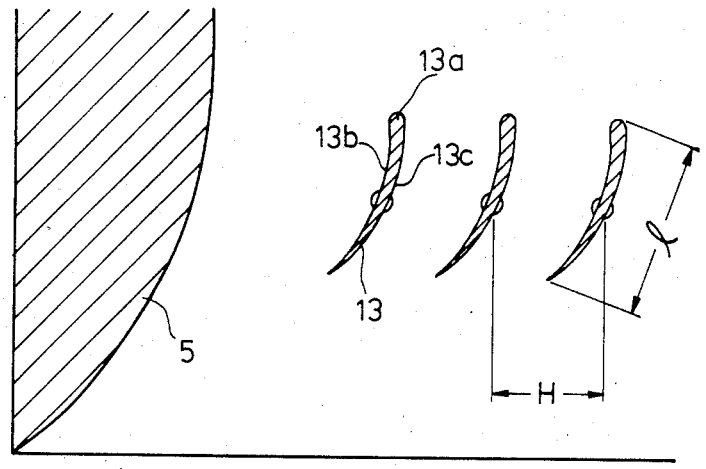
FIG. 10 is an enlarged view of a part of the assembly of FIG. 9.

A second embodiment of the present invention is described with reference to FIG. 9 through FIG. 13. The flow deflecting assembly comprises a fluid passage 2, for instance an exit passage of an air conditioner which has an inlet 3 and an outlet 4. The fluid passage 2, like that shown in FIG. 2, is generally rectangular in cross section and is defined by a pair of opposed parallel broad walls which have a small gap therebetween and a pair of opposed narrower walls which have a a larger gap therebetween and outwardly curved surfaces in the vicinity of the outlet 4, thereby forming guide walls 5 and 6. In this embodiment, the blades have a profile of an air foil configuration as best shown in FIG. 10. That is, the air foil configuration of the blade section has a thick semicircular or semi-eliptic part 13a and 14a in the up stream end and the middle stream and down stream parts of the blades have concave faces 13b and 14b on one side and convex faces 13c and 14c on the other side, wherein the concave faces 13b and 14b are for attaching the flow to the curved faces of the guide walls 5 and 6, respectively. The blades 13 and 14 are disposed in the vicinity of the curved surfaces of the guide walls 5 and 6, and are held in a manner that their angles are adjustable, respectively. The center shafts of the blades 13 and 14 are disposed with a gap between each shaft and its corresponding guide wall which is smaller than the curvature radius of the curved surfaces of the guide walls 5 and 6, and roughly on a line connecting the curvature centers of the curved surfaces. Blades 15 and 16 of like airfoil configuration are disposed in a row between the blades 13 and 14 with predetermined gaps therewith and inbetween, so as to induce attachments of the flow of fluid flowing in the gaps between the guide walls 5, 6 and the blades 7, 8 by means of the Coanda effect. Gaps H between the blades 13 and 15, 16 and 14 are preferably selected to be smaller than chord length l of the blades for the sake of good deflection of the flow of the fluid. On the other hand, in order to decrease resistance to the flow, the number of blades is preferably small. Accordingly, the gap H is preferably about equal of the length l of the chord. Thus the flow of the fluid such as chilled air is bent by cooperative operation of the guide walls 5 or 6 and blades 13, 15, 16 and 14 in a direction as shown by thick white arrows in FIG. 11, FIG. 12 and FIG. 13. But the flow is not deflected in a direction toward either of the broad walls of the passage 2 because the broad walls are flat and disposed parallel to each other.

Figure 11:
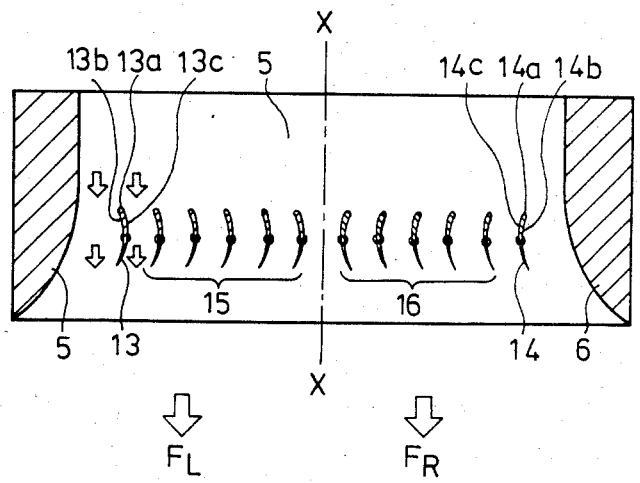
FIG. 11, FIG. 12 and FIG. 13 are views of the embodiment of FIG. 9 in various modes of operation.

When the blades 13, 15, 16 and 14 are adjusted as shown in FIG. 11, that is, when the chords of the blades are arranged in parallel with the center axis X—X of the passage 2, the flow of the fluid is not bent, but is led straight to the outlet 4 as shown by the thick white arrows $F_L$ and $F_R$ in FIG. 11.

Figure 12:
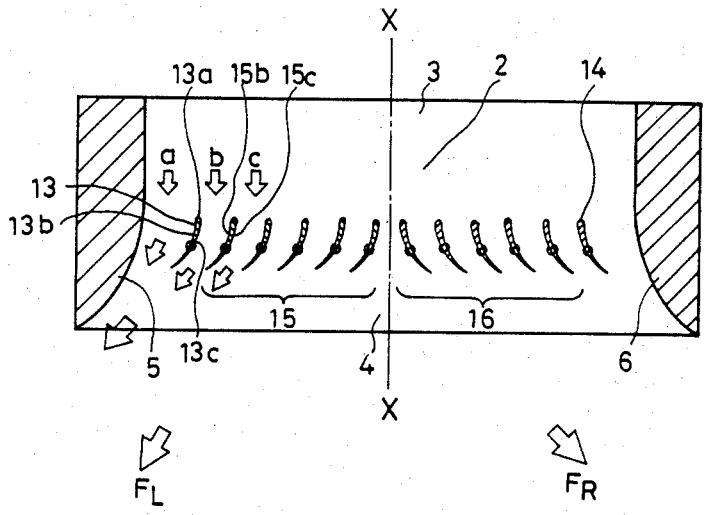

Next, as shown in FIG. 12 when the blades 13 and 15 are tilted in a direction so that their downstream edges approach the curved surface of the guide wall 5, and the blades 14 and 16 are tilted in a direction so that their downstream edges approach the curved surface of the guide wall 6, the left part flow "a" is bent so as to be attached to the curved wall 5 by operation of the concave face 13*b* of the blade 13, and the next divided flow "b" is also bent in the same direction to attach to the convex face 13*c* by means of concave face 15*b*. In the similar way, flow of the fluid passing through the gaps between blades 13 are bent leftwards by the blades 15. As a result, the flow in the left half part is deflected leftwards, and in symmetry with the left half part of the flow the right half part of the flow is deflected rightwards, as shown in FIG. 12.

Figure 13:
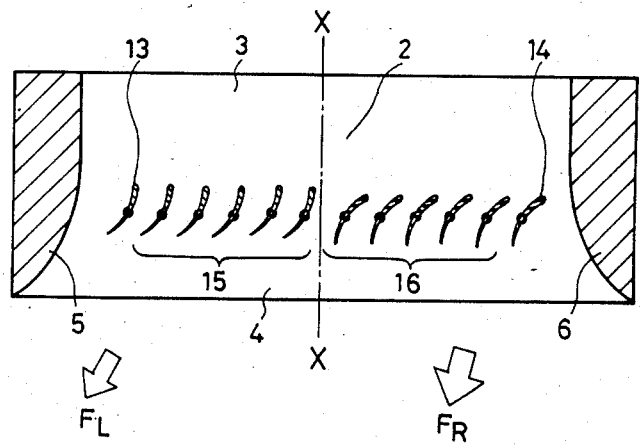

Next as shown in FIG. 13, when the right-half-part blades 14 and 16 are adjusted such that their chords are generally parallel to the chords of the blades 13 and 15 of the left half part, the flow of the fluid of the right half part in the fluid passage 2 is bent moderately leftwards as shown in FIG. 13.

As described with reference to FIG. 11 through FIG. 13, by adjusting the angular positions of the blades in various modes, the deflection mode of the flow can be changed such as: (1) diffusing to both sides of the central axis X—X, (2) directly along the central axis, or in a direction of left or right. In either deflection (1) or (3), the flow deflection is made by utilizing the attachment effect of the flow, and accordingly there is no need for excessive tilting of the blades, and since the blades have rounded upstream edges the rate of flow is not decreased even when the blades are deflected, and hence deflection in a wide angle is achievable.

Furthermore, by appropriately selecting the ratio of the number of left part blades 15 to the number of right part blades 16, it is possible to change the ratio of flow rate of left side flow $F_L$ and to rate of right side flow $F_R$, and therefore the appropriate flow deflection corresponding to a desired purpose is obtainable.

Figure 14:
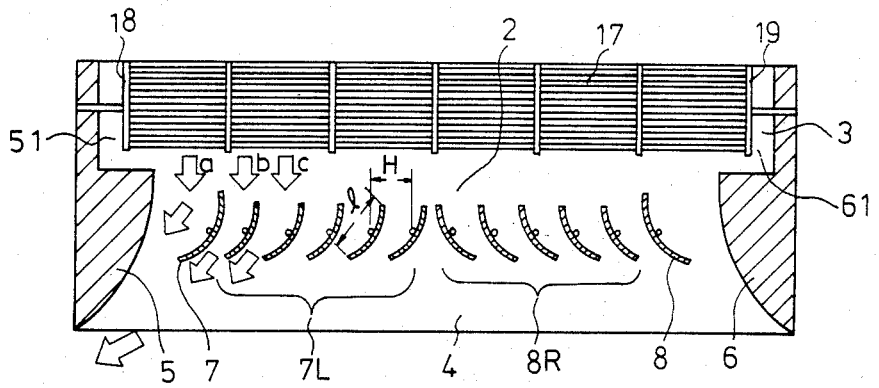
FIG. 14 is a view corresponding to FIG. 2 of still another embodiment of the flow deflecting assembly embodying this invention.
Figure 15:
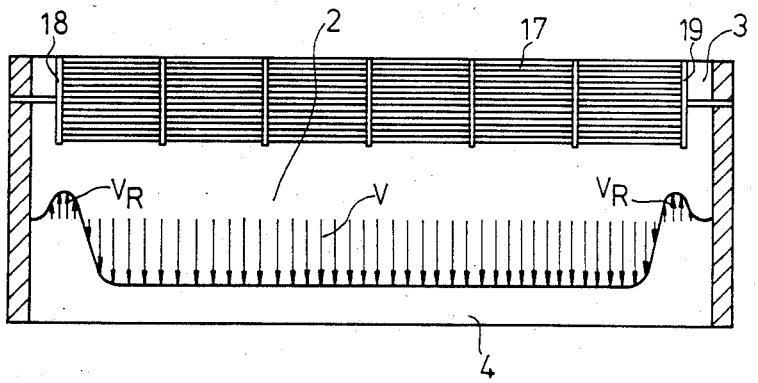
FIG. 15 is a view illustrating velocity distribution of flow of a conventional cross-flow fan in a conventional passage.

A third embodiment is described with reference to the drawings FIG. 14 through FIG. 16. In FIG. 14, a conventional cross-flow fan 17 is provided in the inlet part 3 of the fluid passage 2, and in the midway part and outlet part 4 of the fluid passage 2 a pair of curved guide walls 5 and 6 are provided in a manner that both end parts 18 and 19 of the cross-flow fan 17 are disposed in outward offset parts 51 and 61 of the passage 2 upstream of the guide walls 5 and 6. The reason and effect of the above-mentioned configuration is first elucidated with reference to FIG. 15 showing fluid velocity distribution laterally along a conventional cross-flow fan 17 disposed in a conventional fluid passage where there are no curved guide walls offset bracing inward of end parts of the cross-flow fan and downstream thereof, and second with reference to FIG. 16 which shows fluid velocity distribution laterally along the cross-flow fan shown in FIG. 14 As shown in FIG. 15, when a cross-flow fan is used conventionally, its fluid velocity distribution has three parts $V_R$, V and $V_R$ as shown in FIG. 15. That is, at both end parts of the cross-flow fan, reverse direction flows $V_R$ to the main flow V are induced and thereby the efficiency of the cross-flow fan is lowered. Furthermore, when chilled air is blown, the reverse flow $V_R$ makes undesirable water drops at the sides of the fluid passage. However, by providing the guide walls 5 and 6 having outwardly curving surfaces at the passage outlet and offset parts 51 and 61 embracing both end parts of the cross-flow fan, no undesirable reverse flows are induced, and only forward flow V is produced by the cross-flow fan.

Figure 16:
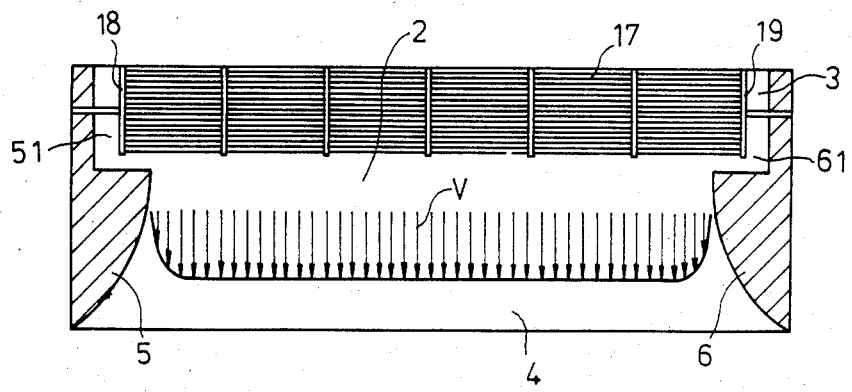
FIG. 16 is a view illustrating velocity distribution of flow of a conventional cross-flow fan disposed in a passage in accordance with the present invention with flow deflecting blades omitted for simplicity.

By providing the curved walls 5 and 6 in the outlet 4 of the fluid passage 2, there is no fear of forming water drops due to reverse flows of air, and orderly forward flow V of the conditioned air is obtainable as shown in FIG. 16.

Figure 17:
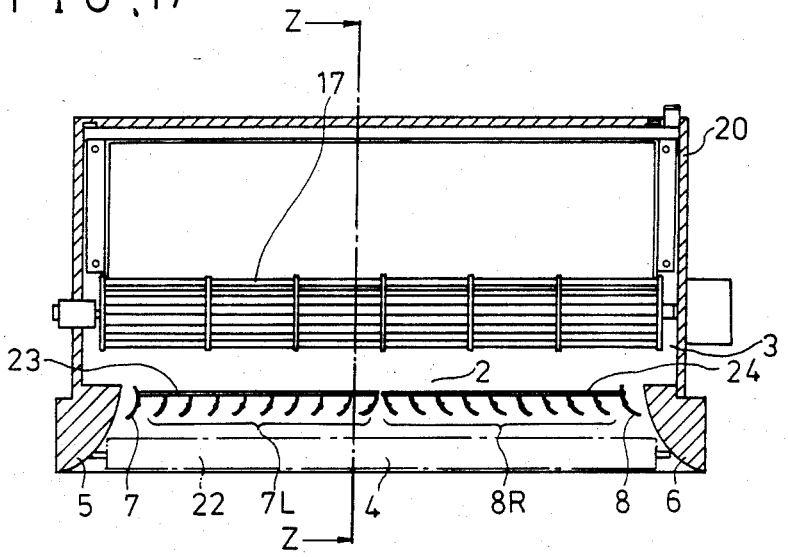
FIG. 17 is a sectional view taken on line Y—Y in FIG. 18 of a heat pump type air conditioner provided with a flow deflecting assembly embodying the present invention.
Figure 18:
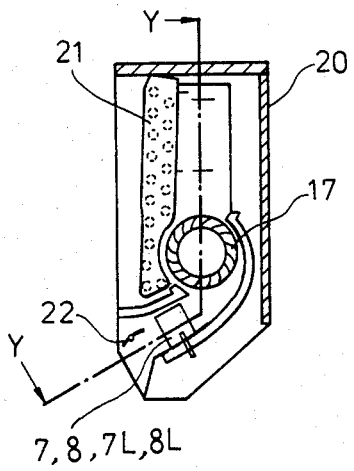
FIG. 18 is a sectional view taken on line Z—Z of FIG. 17.

FIG. 17 and FIG. 18 show an actual heat pump type air conditioner embodying the present invention. In this embodiment, a casing 20 houses a cross-flow fan 17 and a heat exchanger 21 in the upstream space of the casing 20. And further, the air conditioner comprises a pair of curved guide walls 5 and 6, offsets upstream thereof in which both end parts of the cross-flow fan 17 are disposed, a pair of blades 7 and 8 disposed in the vicinity of the upstream parts of the guide walls 5 and 6, rows of blades 7L and 8R which are disposed between the blades 7 and 8 in uniform pitch dispositions, and a horizontal blade 22 for vertical deflection of flow of fluid. The blades 7 and 7L are connected by a connecting rod 23, and the other blades 8 and 8R are connected by a connecting rod 24. In this configuration, when the cross-flow fan 17 rotates, fluid, such as air which is heat-exchanged by the heat exchanger 21, is driven downward by the cross-flow fan 17, and then is deflected by the blades 7, 7L, 8R and 8 in the aforementioned manner as shown with reference to FIG. 5, FIG. 6, FIG. 7, FIG. 8, FIG. 11, FIG. 12 and FIG. 13. Thus, the conditioned air is emitted in wide range of deflected directions by adjusting the angles of the blades 7, 7L or 8R, 8.

As a result of the above-mentioned configuration, the flow deflecting assembly can deflect the flow of the output air in a range of as wide as about two times the angle of the conventional flow deflection means, as a result of utilization of the attachment effect of the curved surface guide walls, and therefore comfortable air conditioning is obtainable.

What is claimed is:

1. A flow deflecting assembly comprising:

a fluid passage generally rectangular in cross section defined by a pair of parallel opposed broad walls disposed with a short distance therebetween and a pair of opposed narrower walls disposed with a longer distance therebetween, and having an inlet and an outlet, said narrower walls have opposed faces that curve outward in the vicinity of said outlet to form guide walls, a pair of flow deflecting blades of curved profile extend between said broad walls and are mounted to rotatable center shafts, said blades being respectively disposed in the vicinities of but spaced from said curved faces of said guide walls, the gaps between said shafts and said curved faces of guide walls being smaller than the radius of curvature of said curved surfaces of said guide walls, the downstream edge of said blades being disposed upstream of said passage outlet and downstream of the starting point of said curved surfaces of said guide walls so that said blades can be adjusted to induce attachment of the flow to said curved faces, and a row of deflecting blades of curved profile, which extend between said broad walls and are held in an angle-adjustable manner, are disposed between said pair of deflecting blades with predetermined pitches therebetween.

2. A flow deflecting assembly in accordance with claim 1, wherein the gaps between the center parts of all the blades are substantially equal to the chord length of the blades in the row.

3. A flow deflecting assembly in accordance with claim 1, wherein the fluid passage, the curved faces and the blades are of symmetrical configuration with respect to a central plane extending perpendicular to the broad walls.

4. A flow deflecting assembly in accordance with claim 3 including means for remotely controlling the deflection angle of all the blades on one side of the plane simultaneously and all the blades on the other side of said plane simultaneously.

5. A flow deflecting assembly in accordance with claim 1 wherein the blades are of airfoil profile with their thicker edge disposed upstream, said blades have a concave surface on one side and a convex surface on the other side and said concave surfaces of the blades of the pair are disposed in opposition to their corresponding curved faces of the guide walls.

6. A flow deflecting assembly in accordance with claim 1 including a cross-flow fan extending between the narrower walls upstream of the guide walls and wherein the passage has outwardly offset parts in which the ends of said fan are disposed.

* * * * *